United States Patent [19]

Welch

[11] Patent Number: 4,521,761

[45] Date of Patent: Jun. 4, 1985

[54] SMALL OUTLINE POTENTIOMETER

[75] Inventor: Edward W. Welch, Dallas, Pa.

[73] Assignee: Sangamo Weston, Inc., Norcross, Ga.

[21] Appl. No.: 581,152

[22] Filed: Feb. 17, 1984

[51] Int. Cl.[3] ..... H01C 10/34; H01C 10/30

[52] U.S. Cl. ..... 338/174; 338/184; 338/162; 338/202

[58] Field of Search ..... 338/160, 162, 163, 164, 338/167, 170, 174, 184, 134, 199, 202

[56] References Cited

U.S. PATENT DOCUMENTS

| | | | |
|---|---|---|---|
| 3,597,837 | 8/1971 | Mack | 29/610 |
| 3,729,817 | 5/1973 | De Rouen et al. | 29/610 |
| 3,732,521 | 5/1973 | Hauenstine et al. | 338/184 |
| 3,869,789 | 3/1975 | Yungblut et al. | 29/610 |
| 4,105,987 | 8/1978 | Spence et al. | 338/164 |
| 4,114,131 | 9/1978 | Nakatsu et al. | 338/162 |
| 4,114,132 | 9/1978 | De Rouen et al. | 338/174 |

FOREIGN PATENT DOCUMENTS

| | | | |
|---|---|---|---|
| 1282821 | 7/1972 | United Kingdom | 338/174 |
| 1347473 | 2/1974 | United Kingdom | 338/134 |
| 1604104 | 12/1981 | United Kingdom | 338/199 |

*Primary Examiner*—Roy N. Envall, Jr.
*Assistant Examiner*—C. N. Sears
*Attorney, Agent, or Firm*—Dale Gaudier

[57] ABSTRACT

A single-turn miniature potentiometer includes a first substrate having an annular conductive track formed thereon and a second substrate facing the first and having an annular resistive track formed thereon. An insulating layer is placed between the two substrates and has an opening provided therein for receiving a disk-like rotor which bears an electrically conductive wiper for simultaneously contacting both the conductive and resistive tracks. Electrical connections are made between the resistive and conductive tracks by means of external U-shaped clips.

14 Claims, 7 Drawing Figures

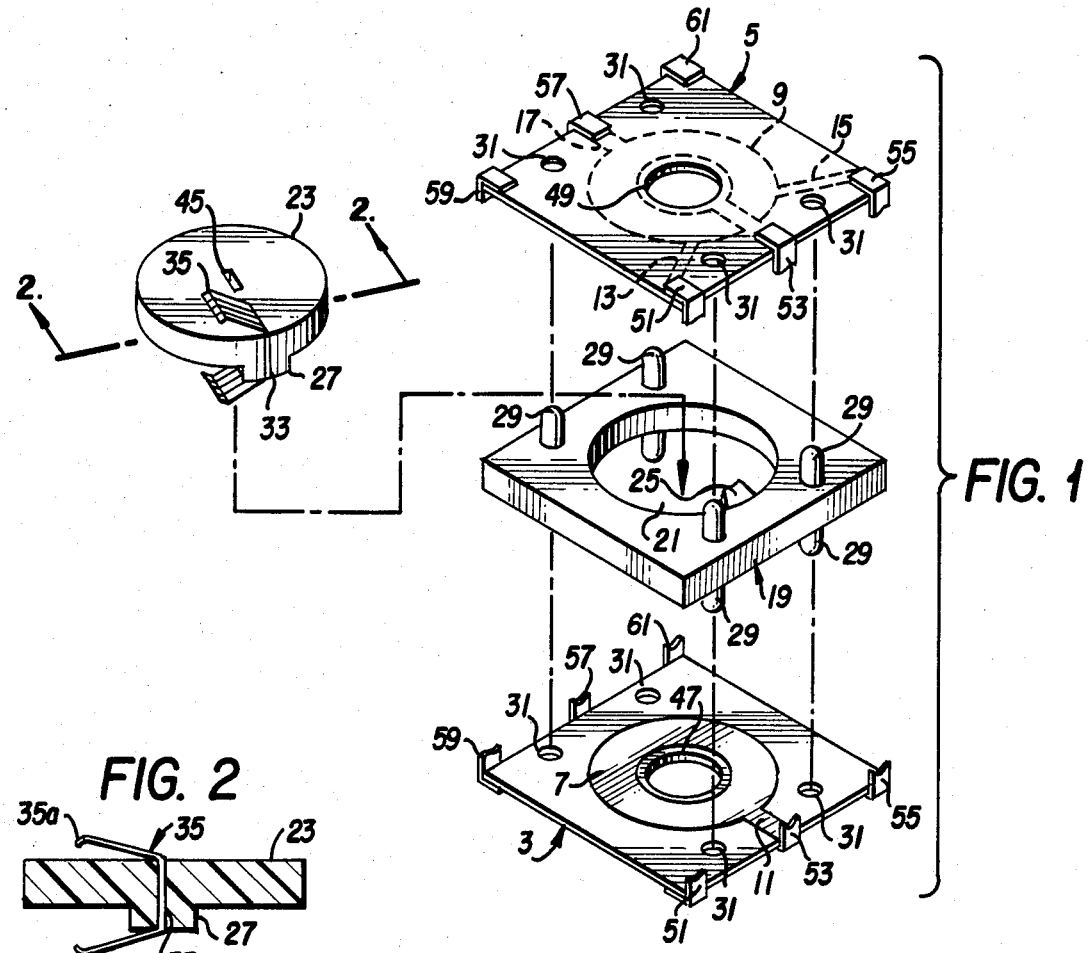
FIG. 1
FIG. 2
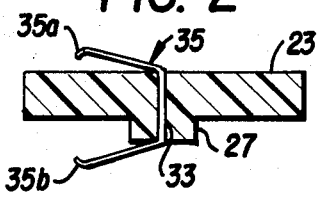
FIG. 3
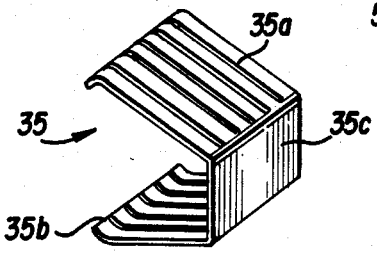
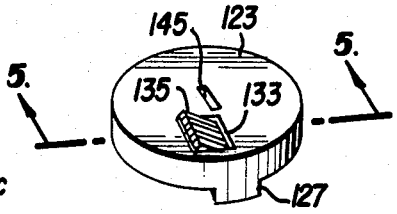
FIG. 4
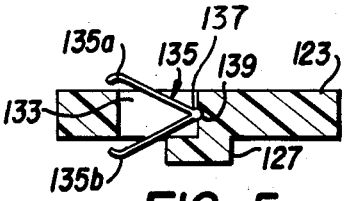
FIG. 5
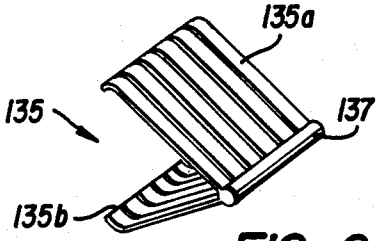
FIG. 6
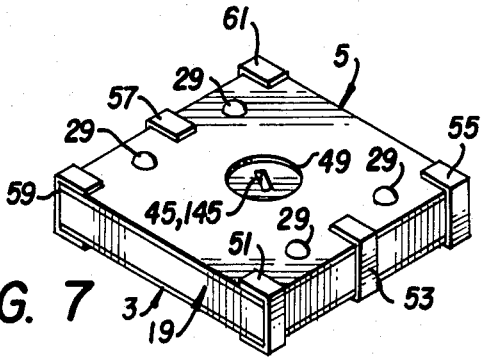
FIG. 7

SMALL OUTLINE POTENTIOMETER

BACKGROUND OF THE INVENTION

1. Field of the Invention

The present invention relates to the field of potentiometers, and more particularly to a miniature single-turn potentiometer having improved reliability and performance.

2. Description of the Prior Art

Miniature single-turn potentiometers have been available in various forms for many years. Typically, such a potentiometer includes a substrate upon which a first annular track of resistance material is formed. A second annular track of conductive material is disposed concentric to the first track on the substrate. A conductive wiper is attached to a movable rotor. The rotor and wiper are arranged such that electrical contact is made between the conductive track and the resistive track by the wiper. Leads are arranged on the substrate connecting ends of the annular resistive track (which is not laid out as a full circle but rather resembles the letter C) and the annular conductive track. As the rotor is turned about its axis, the wiper simultaneously contacts the conductive track and the resistive track. As seen from the conductive leads, the relative resistance measured between the conductive annular track and one end of the C-shaped resistive track will vary in accordance with the distance from the end of the track to where the wiper is contacting the resistive track. Such arrangements are shown, for example, in U.S. Pat. Nos. 3,597,837, 3,729,817 and 3,869,789.

In the aforementioned patents the wiper generally takes the form of a solid piece of resilient conductive material, such as beryllium copper. However, it is known to improve the contact between the annular conductive track and resistive track through the use of a V-shaped wiper formed of a series of conductive wires arranged parallel to one another, such as shown in U.S. Pat. No. 4,114,132. Such an arrangement has the advantage that the wire tips are free to flex with respect to each other and thus are less prone to causing a bad connection due to surface irregularities in the conductive or resistive tracks.

However, the above-described arrangements wherein the resistive and conductive tracks are disposed concentric to one another on the same substrate suffer from the drawback that in a miniature (e.g. less than ½ inch) square potentiometer package there is very little room to apply both the conductive and resistive tracks concentric to one another. This means that the width of each track is relatively narrow and thus the amount of area available for contact with the wiper is small. This results in less reliable contact between the portions of the wiper contacting the resistive track and the conductive track.

U.S. Pat. No. 4,114,131 shows a type of potentiometer in which an annular resistive track and an annular conductive track are disposed on opposite sides of a rotor. This arrangement overcomes some of the difficulties associated with having the resistive and conductive tracks side by side on the same substrate. However, this potentiometer uses a rather complicated two-piece wiper arrangement for contacting the tracks on both sides of the rotor.

Another drawback of prior art potentiometer designs is that they generally include three or more wire leads or terminals which are brought out at right angles to the potentiometer package for connection with electrical circuit. While such an arrangement can be adapted for mounting a potentiometer either vertically or horizontally with respect to a printed circuit board by the simple expedient of bending the wire legs, such devices are not easily adapted for use with certain types of automatic electronic component assembly or insertion machinery. This is because the wire leads or terminals of the component must be precisely located with respect to openings provided in an electronic circuit board prior to insertion.

One type of automatic circuit board assembly device which is becoming more prevalent is one which utilizes electronic components which do not have leads formed on them at all—instead, small conductive areas are provided on the outer surface of the electrical device which are designed to be mated with corresponding conductive areas formed on the surface of the printed circuit board. The electrical component is bonded to the circuit board using any one of a number of well-known techniqes.

It would therefore be of great benefit if there were available a miniature potentiometer having a simple and reliable arrangement for making contact between a conductive track and a resistive track and which is adaptable for automatic mounting to a printed circuit board without the need for precisely locating external leads.

SUMMARY OF THE INVENTION

It is an object of the present invention to provide a miniature potentiometer having improved contact reliability between conductive and resistive tracks.

It is a further object of the present invention to provide a miniature potentiometer which is easily mounted to a printed circuit board and which can be used in situations where a leadless circuit package would be advantageous.

It is yet another object of the present invention to provide a miniature potentiometer which is simple to manufacture and reliable in performance.

These and other objects are achieved by the present invention wherein there is provided a potentiometer including a first substrate having a resistive layer formed thereon and a second substrate having a conductive layer formed thereon, with the first and second substrates being arranged in a spaced-apart facing relationship with respect to each other. Preferably, the resistive layer and conductive layer are arranged as annular tracks on the first and second substrates. A rotor, which can be circular in form, is disposed between the first and second substrates. The rotor includes an opening for receiving a segmented conductive wiper. The wiper is arranged in a fashion to simultaneously contact both the resistive layer of the first substrate and the conductive layer of the second substrate.

Preferably, the wiper comprises a U-shaped piece of resilient conductive material and has a plurality of flexible finger members formed thereon. Alternatively, the wiper comprises a plurality of V-shaped wires aligned with each other and attached together at their vertices in the form of a V-shaped trough.

The potentiometer may further include a layer of insulating material disposed between the first and second substrate and an opening for receiving the rotor. The insulating layer may further include a shoulder formed in the opening for cooperating with a shoulder formed on the rotor to prevent rotation of the rotor beyond 360°. The rotor may further include a slot for enabling rotation of the rotor by means, such as a screwdriver, external to the potentiometer.

As a further feature of the invention, the potentiometer includes a series of conductive leads formed on the substrate for connecting the resistive layer and conductive layer to points external to the substrates. Preferably, these points are connected together by means of U-shaped clips which are arranged external to the potentiometer.

The invention may further include means for securing the substrates and insulating layers together comprising at least a pair of pillars of thermoplastic material formed on opposite sides of the insulating layer which cooperate with openings formed in the substrates which receive the pillars. The exposed ends of the pillars, which project above the outer surfaces of the substrates where the substrates are assembled to the insulating layer are then heat-staked to cause the substrates and insulating layer to be securely joined together.

By placing the conductive and resistive tracks on two separate substrates, the problems associated with prior art potentiometers, which use annular conductive and resistive tracks placed concentric to one another on a single substrate, are eliminated. This is due to the increased surface area available for the individual resistive and conductive tracks on the two separate substrates, and results in better contact between the arms of the wiper and the surfaces of these tracks. This is especially important in small (e.g. less than ½ inch square) potentiometers where there is only a very limited amount of surface area available on the substrates for applying the resistive and conductive tracks. The use of a segmented wiper composed of a number of resilient members insures good contact between the wiper and the surfaces of the resistive and conductive tracks, despite any surface irregularities which may be present.

A further advantage of the present invention is that the U-shaped clips used to connect the electrical terminal of the potentiometer package together enable the completed potentiometer to be mounted either horizontally or vertically with respect to a printed circuit board and allows the potentiometer to be mounted to the printed circuit board in situations where a standard miniature potentiometer having wire-type leads could not be used. Further, the leadless configuration of the present invention is adaptable for use with automatic mounting machinery.

BRIEF DESCRIPTION OF THE DRAWING FIGURES

These and other features and objects of the present invention will be clear from the following detailed description of the invention, when taken in conjunction with the drawing figures wherein:

FIG. 1 is an exploded perspective view of a potentiometer constructed in accordance with the present invention;

FIG. 2 is a cross-sectional view of the rotor of FIG. 1 taken along section lines 2—2;

FIG. 3 is a perspective view of the rotor wiper shown in FIGS. 1 and 2;

FIG. 4 is a perspective view of a second embodiment of a rotor for use with the potentiometer of FIG. 1;

FIG. 5 is a cross-sectional view of the rotor shown in FIG. 4 taken along section lines 5—5;

FIG. 6 is a perspective view of the rotor wiper shown in FIGS. 4 and 5; and

FIG. 7 shows the potentiometer of FIG. 1 after it has been fully assembled.

DETAILED DESCRIPTION OF THE PREFERRED EMBODIMENTS

As shown in FIG. 1, potentiometer 1 comprises a first substrate 3 and a second substrate 5 which are identical in construction and are comprised of an insulative material, such as alumina. Substrate 3 has an annular track or layer 7 of conductive material formed thereon. This conductive material may be formed from a thick-film paste composed of glass, metal and binders and is applied to substrate 3 by well-known screening and firing processes. Substrate 5 has a similar annular track 9 formed thereon from a resistive material, such as a thick-film paste composed of carbon metal, glass and binders. This material is applied to a surface of substrate 5 using a similar screening and firing process as used for the application of the conductive track to substrate 3.

Resistive track 9 is shown in dashed line in FIG. 1 and is laid out in a generally C-shaped pattern. As shown in FIG. 1, conductive track 7 and resistive track 9 are arranged on the surfaces of substrates 3 and 5, respectively, in a facing, spaced-apart relationship. Conductive track 7 further includes a conductive lead 11 which is arranged on the surface of substrate 3 so as to connect conductive track 7 to a point along the edge of the substrate and terminates at a terminal at a point on the side of substrate 3 opposite conductive track 7. Similarly, resistive track 9 includes three conductive leads 13, 15 and 17 for connecting various points of resistive track 9 to points along the edge of substrate 5 and to terminals formed on the side of substrate 5 opposite resistive track 9. Conductive leads 13 and 15 are connected to opposite ends of resistive track 9. Conductive lead 17 may be connected to the center or midpoint of conductive track 9 and is used where a center-tapped potentiometer is desired.

Between substrates 3 and 5 there is arranged a layer of insulating material 19, preferably formed from thermoplastic material, such as polyethersulfone or the like. Insulating layer 19 includes an opening 21 for receiving a rotor 23 (FIG. 1) or 123 (FIG. 4), which are described in more detail below.

Opening 21 in insulating layer 19 includes a shoulder 25 which cooperates with a shoulder 27 or 127 formed as part of rotor 23 or 123, respectively, to act as a stop or limit means for preventing rotation of rotor 23 or 123 beyond 360°.

Insulating layer 19 further includes one or more pairs of pillars 29 arranged on opposite sides of insulating layer 19. Pillars 29 are formed from the same thermoplastic material from which insulating layer 19 is made. Openings 31 are provided in substrates 3 and 5 to receive pillars 29 when substrates 3 and 5 are assembled to insulating layer 19. Pillars 29 cooperate with openings 31 in substrates 3 and 5 to accurately locate and position the substrates with respect to each other and insulating layer 19. Further, as described below, one substrates 3 and 5 have been assembled to insulating layer 19, along with rotor 23 or 123, the ends of pillars 29 exposed through openings 31 may then be heat-staked to secure the potentiometer elements together.

Rotor 23 or 123 is formed from insulating material, such as a thermoplastic polyester, and has a circular or disk-like shape. The rotor is dimensioned to fit closely within opening 21 of insulating layer 19, but without binding. As mentioned earlier, one side of rotor 23 or 123 includes a shoulder 27 or 127, respectively. Shoulder 27 or 127 is arranged such that when rotor 23 or 123 is placed within opening 21 of insulating layer 19 it cooperates with shoulder 25 to prevent rotation of the rotor beyond 360°.

As shown in FIGS. 1 and 2, rotor 23 includes an opening or slot 33 for receiving a U-shaped wiper 35. Wiper 35 is formed from a stamped-out piece of resilient conductive material, such as beryllium copper or a nickel-silver alloy. Wiper 35 has a U-shaped form composed of three segments: arms 35*a* and 35*b* and a base segment 35*c* connecting the arms. As shown in FIGS. 2 and 3, the arms 35*a*, 35*b* of wiper 35 are each slit a number of times to form a plurality of flexible members or fingers as shown in FIG. 3.

The U-shaped wiper 35 of FIGS. 1 and 3 is mounted in opening or slot 33 of rotor 23 by sliding the base 35*c* of the wiper into the slot and positioning the wiper arms as shown in FIG. 2 so that arms 35*a* and 35*b* of wiper 35 extend above and below the surface of the rotor.

Alternatively, as shown in FIGS. 4–6, the wiper may comprise a plurality of small diameter wires 135 formed from a stiff, but resilient, material such as beryllium copper. The wires are formed having roughly a V-shape and are aligned and joined along their vertices by means of a wire 137 welded or soldered thereto to form a roughly V-shaped trough. While the vertices of the wires making up wiper 135 are fixed with respect to one another, the opposite arms 135*a* and 135*b* of each wire are free to flex independently of each other.

As shown in FIGS. 4 and 5, V-shaped wiper 135 is arranged in opening 133 of rotor 123 as shown in FIG. 5. The wire 137 which joins the vertices of the individual wires making up wiper 135 is attached or otherwise secured to a portion of opening 133. As shown in FIG. 5, this attachment can be made by press-fitting wire 137 into a groove or notch 139 formed on one interior wall of opening 133. When thus arranged, the ends of the arms 135*a*, 135*b* of wiper 135 extend above and below the surface of rotor 123, as shown in FIG. 5.

It should be noted that either type of wiper 35 or 135 results in a brush-like contacting area at the end of each arm of the segmented wiper.

Rotors 23 and 123 further include an opening or slot 45 or 145, respectively, for accomodating the end of an adjustment tool, such as a screwdriver.

Potentiometer 1 is assembled to form a completed unit as follows. Insulating layer 19 is placed over substrate 3 with pillars 29 being received in openings 31 in substrate 3. Wiper 35 or 135 is assembled to rotor 23 or 123, respectively, and the rotor is then placed in opening 21 of insulating layer 19. Substrate 5 is then placed over insulating layer 19 with pillars 29 being received in openings 31 of substrate 5 and an opening 49 formed in substrate 5. Openings 47 and 49 are respectively formed in substrates 3 and 5 to allow access to rotor adjustment slot 45.

The ends of pillars 29 which protrude through openings 31 in substrates 3 and 5 are then heat-staked (e.g. a hot iron is applied to the ends of pillars 29) to cause the thermoplastic material from which pillars 29 are formed to flow and form a cap over each of the openings 31. This acts to secure all of the components of potentiometer 1 together.

A potentiometer assembled in accordance with the present invention is shown in completed form in FIG. 7. U-shaped clips 51, 53, 55 and 57 are used to join the points on the outer surfaces of substrates 3 and 5 where conductive leads 11, 13, 15 and 17 are disposed. The U-shaped clips may be secured to the conductive leads through the use of a conventional reflow soldering process. One or more additional U-shaped clips 59, 61 may be utilized to provide additional security to potentiometer package 1. However, these clips are not electrically connected to any components within the potentiometer package.

Clips 51, 53, 55, 57, 59 and 61 are formed from a resilient conductive material, such as beryllium copper, and are arranged such that the assembled potentiometer 1 can be mounted either horizontally or vertically to terminal pads provided on a printed circuit board. An advantage of this leadless arrangement is that when using automatic assembly machinery no leads need be inserted into openings on a circuit board nor is there a lead bending operation required.

Rotors 23 or 123 are readily rotated to adjust the resistance of the potentiometer by means of a tool, such as a screwdriver, which is applied to slot 45 or 145 provided in rotor 23 or 123, respectively.

The opposite faces of rotors 23 and 123 may further include short stub-like axles or shafts (not shown) formed concentric with the axis of rotation of the rotor and dimensioned to fit within substrate openings 47 and 49.

In addition to the above features, a chief advantage of the arrangement of the present invention is that the amount of surface area available for forming conductive track 7 and resistive track 9 is approximately doubled compared to prior art arrangements in which the conductive and resistive tracks are placed concentric with one another on the same substrate, while utilizing a simple and reliable wiper mechanism. The present arrangement therefore results in more reliable operation of the potentiometer. In addition, the potentiometer is easily constructed and assembled and has a minimum of moving parts.

While the invention has been described in considerable detail, it will be appreciated that various modifications and changes would occur to one of skill in the art. Accordingly, the foregoing is intended to be descriptive, but not limitative, of the invention which is defined by the appended claims.

What is claimed is:

1. A potentiometer comprising:

a first substrate having a conductive layer formed thereon;

a second substrate having a resistive layer formed thereon, the first and second substrates being arranged in a spaced-apart facing relationship with respect to each other;

a circular disk-like rotor disposed between the first and second substrates, the rotor including a radial opening formed therein; and a one-piece conductive wiper formed from a conductive resilient material disposed in the rotor opening, the wiper including a pair of arms having a series of parallel resilient members formed thereon extending above and below the plane of the rotor with the resilient members of one arm arranged to contact the conductive layer of the first substrate and the resilient members of the other arm arranged to contact the resistive layer of the second substrate.

2. The potentiometer of claim 1 wherein the conductive layer and the resistive layer are arranged as annular tracks on the first and second substrates, respectively.

3. The potentiometer of claim 1 wherein the rotor includes means for enabling adjustment of the rotor by means external to the potentiometer.

4. The potentiometer of claim 1 wherein the adjustment means comprises a slot formed along the axis of rotation of the rotor.

5. The potentiometer of claim 1 further including stop means for preventing rotation of the rotor beyond 360°.

6. The potentiometer of claim 1 further including a layer of insulating material disposed between the first and second substrates, the insulating layer including an opening for receiving the rotor.

7. The potentiometer of claim 6 wherein the insulating layer includes stop means for preventing rotation of the rotor beyond 360°.

8. The potentiometer of claim 7 wherein the stop means comprises a first shoulder formed in the opening of the insulating layer and a second shoulder formed on the rotor and arranged to cooperate with the first shoulder so as to prevent rotation of the rotor beyond 360°.

9. The potentiometer of claim 6 further including means for securing the substrates and insulating layer together.

10. The potentiometer of claim 9 wherein the securing means comprises at least a pair of pillars of thermoplastic material formed on opposite sides of the insulating layer, and openings formed in the substrates to receive the pillars, whereby ends of the pillars exposed through the substrate openings may be heat-staked to the substrates.

11. The potentiometer of claim 1 wherein the wiper comprises a U-shaped strip of conductive resilient material having a series of parallel slits provided along arms thereof to form a said of resilient members.

12. The potentiometer of claim 1 wherein the wiper comprises a plurality of V-shaped wires aligned with each other in the form of a V-shaped trough and attached together at their vertices to form said resilient members.

13. The potentiometer of claim 1 wherein the first and second substrates include conductive leads formed thereon for connecting the conductive layer and resistive layer to points external to the substrates.

14. The potentiometer of claim 13 further including at least one U-shaped conductive clip to connect the points external to the substrates to which the conductive leads are attached.

* * * * *